US006183023B1

(12) United States Patent
Yulkowski

(10) Patent No.: US 6,183,023 B1
(45) **Date of Patent: *Feb. 6, 2001**

(54) DOOR WITH INTEGRATED FIRE EXIT DEVICE

(76) Inventor: Leon Yulkowski, 4390 Derry, Bloomfield Hills, MI (US) 48302

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/197,144

(22) Filed: Nov. 20, 1998

(51) Int. Cl.[7] ..... E05B 65/10

(52) U.S. Cl. ..... 292/92; 292/DIG. 31; 292/336.3

(58) Field of Search ..... 292/92, 217, 223, 292/196, 336.3, DIG. 31; 70/92, 93, 94; 49/141

(56) References Cited

U.S. PATENT DOCUMENTS

| | | | | |
|---|---|---|---|---|
| 3,020,075 | * | 2/1962 | Johnstone et al. | 292/DIG. 31 |
| 3,044,815 | * | 7/1962 | Soss | 292/DIG. 31 |
| 3,694,017 | * | 9/1972 | Keeler, II et al. | 292/DIG. 31 |
| 3,762,753 | | 10/1973 | Yulkowski . | |
| 3,765,198 | * | 10/1973 | Horgan, Jr. | 70/92 |
| 3,769,822 | | 11/1973 | Yulkowski . | |
| 3,785,687 | | 1/1974 | Yulkowski . | |
| 3,890,813 | * | 6/1975 | Cothron | 70/92 |
| 3,940,886 | * | 3/1976 | Ellingson, Jr. | 49/319 |
| 3,969,845 | | 7/1976 | Yulkowski . | |
| 3,973,289 | | 8/1976 | Yulkowski . | |
| 4,093,284 | | 6/1978 | Yulkowski . | |
| 4,545,606 | * | 10/1985 | Vodra | 292/92 |
| 4,839,988 | * | 6/1989 | Betts et al. | 49/141 |
| 5,016,927 | * | 5/1991 | Toledo | 292/92 |
| 5,219,385 | * | 6/1993 | Yeh | 70/92 |
| 5,297,315 | | 3/1994 | Yulkowski . | |
| 5,301,989 | * | 4/1994 | Dallmann et al. | 292/DIG. 31 |
| 5,349,782 | | 9/1994 | Yulkowski . | |
| 5,375,894 | * | 12/1994 | Schlack | 292/DIG. 31 |
| 5,400,474 | | 3/1995 | Yulkowski . | |
| 5,570,915 | * | 11/1996 | Asadurian | 292/DIG. 31 |
| 5,620,212 | * | 4/1997 | Bourne et al. | 292/113 |
| 5,813,710 | * | 9/1998 | Anderson | 292/DIG. 31 |

OTHER PUBLICATIONS

Brochure entitled "Total Door", undated.

* cited by examiner

*Primary Examiner*—Lynne H. Browne
*Assistant Examiner*—John B. Walsh
(74) *Attorney, Agent, or Firm*—Kevin G. Mierzwa; Artz & Artz, P.C.

(57) ABSTRACT

A door with an integrated exit device has an operational bar which at least partially extends across the door. The operational bar is located within a recess in the face of the door. The operational bar has at least one arm that extends into a channel, which is formed in cooperation with the recess. The door has a locking channel which extends along the vertical edge of the door. The locking channel is coupled to a vertical stile that is fixedly located on the vertical edge of the door. The locking channel and the vertical stile are pivotally coupled by a clip. A blocking member is located within the vertical stile. The operational bar has an actuator arm located within the door and within the vertical stile. As the operational bar is pushed inward, actuator arm pushes blocking member to an open position which also allows locking channel to pivot to an open position. If access is required from both sides of the door, a handle may be located outside of the door and coupled to the operational bar by a connection arm. The connection arm moves the operational bar in cooperation with movement of the handle.

27 Claims, 3 Drawing Sheets

DOOR WITH INTEGRATED FIRE EXIT DEVICE

BACKGROUND OF THE INVENTION

The present invention relates generally to a door assembly for an opening of a building. More specifically, the present invention relates to a door having a fire exit release device.

A fire exit release is a separate component mounted on the face of the door. The fire exit release usually consists of a push bar that extends across the face of the door. Some push bars are activated by pushing the bar in a horizontal plane. Other push bars are rods that extend across the face of the door and are rotated about an axis to unlock the door.

These known push bars require that several other mechanisms be mounted to the door to provide the latching function. Commonly, strikes are mounted on the head or jam of the frame. Strikes may also be mounted in a recess on the floor. Vertical rods extend between the push bar and the strikes. These vertical bars usually extend on the outside of the door on the same side as the push bar.

Several disadvantages are present in known fire exit assemblies. One disadvantage with such assemblies is that the assembly is typically installed after the door is mounted in the frame at the job site. This can be costly because skilled trades must be employed to perform the installation. Also, the device cannot be tested and adjusted prior to transporting the components to the jobsite. Prior testing is desirable for a door installation.

Another disadvantage of known exit devices is that because the vertical rods are mounted on the outside of the door, the door can be found or rendered inoperative by pushing pencils, pens, or other implements into or behind the device. Yet another disadvantage of the protruding device is that the moving mechanisms can also be caught on clothing or provide a place for a finger to be caught. Yet another disadvantage of an exteriorly mounted fire exit device is that strikes located on the jam or the head of the frame are an added component which increases cost and which is also not aesthetically pleasing.

SUMMARY OF THE INVENTION

It is, therefore, one object of the invention to provide an aesthetically pleasing exit device that does not allow for the device to be easily defeated, or easily caught on persons or clothing.

In one aspect of the invention, a door with an integrated fire exit device has an operational bar which partially extends across the door. The operational bar is located within a recess in the face of the door. The operational bar has at least one arm that extends into a channel, which is formed in cooperation with the recess. The door has a locking channel which extends along the vertical edge of the door. The locking channel is coupled to a vertical stile that is fixedly located on the vertical edge of the door. The locking channel and the vertical stile are pivotally coupled by a clip. A blocking member is located within the vertical stile. The operational bar has an actuator arm located within the door and within the vertical stile. As the operational bar is pushed inward, actuator arm pushes blocking member to an open position which also allows locking channel to pivot to an open position. If access is required from both sides of the door, a handle may be located outside of the door and coupled to the operational bar by a connection arm. The connection arm moves the operational bar in cooperation with movement of the handle.

One advantage of the invention is that the number of parts used in this exit device is reduced from that in known devices.

Another advantage of the invention is that one length of operational bar can accommodate a variety of door widths since the length of operational bar is not dependent on the door size.

Other objects and features of the present invention will become apparent when viewed in light of the detailed description of the preferred embodiment when taken in conjunction with the attached drawings and appended claims.

DETAILED DESCRIPTION OF THE PREFERRED EMBODIMENT

Figure 3:
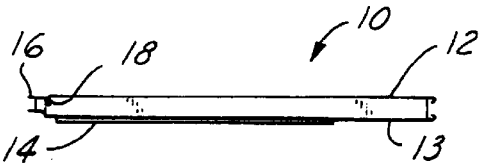
FIG. 3 is a top view of the door of FIG. 1 according to the present invention.

Referring now to the drawings, like reference numerals are used to identify identical components in the various views. While a door is illustrated with respect to a single door having an exit device, the teachings may apply equally to any type of door including a pair of exit doors.

Figure 1:
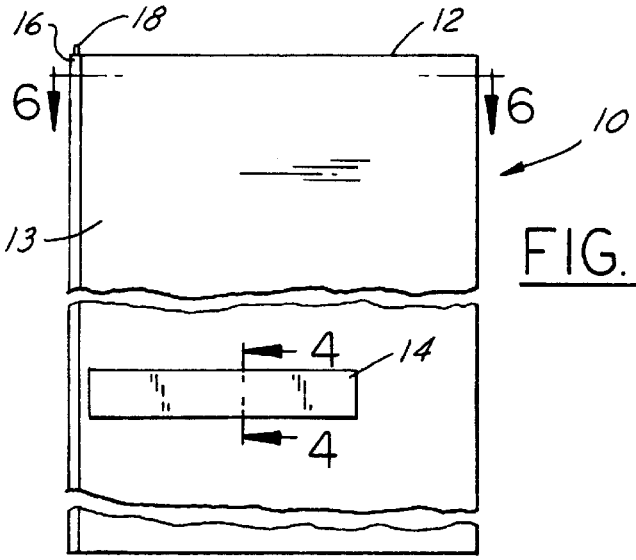
FIG. 1 is a front elevational view of a door having an exit device according to the present invention.
Figure 2:
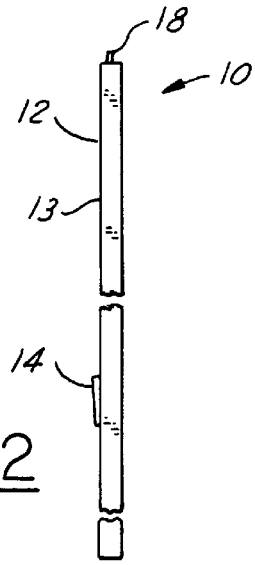
FIG. 2 is a side view of a door having an exit device according to the present invention.

Referring now to FIGS. 1–3, a door assembly 10 has a door 12 with a face 13, an operational bar 14, a locking channel 16, and a retainer 18.

While door 12 is preferably a commercial door, door 12 may also be a residential door. Door 12 may be formed of wood, metal, metal around wood, with or without glass panels or any other suitable material for doors.

As will be further described below, operational bar 14 is located partially recessed within door 12. Operational bar 14 is operatively connected to locking channel 16. Locking channel 16 engages a portion of the door frame to allow door to be closed and released. Retainer 18 also operatively coupled to locking channel 16. Retainer 18 extends from the top of the door and allows locking channel 16 to return to its closed position while the door is being closed within a frame.

Figure 4:
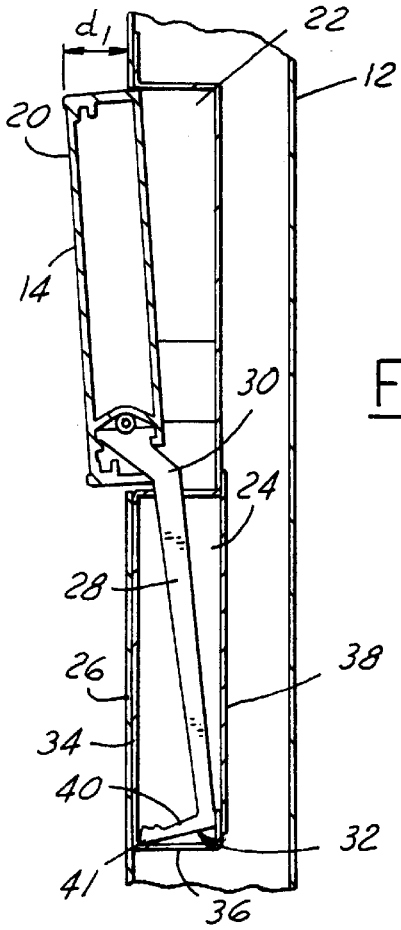
FIG. 4 is a cross-sectional view of an exit device having the operational bar in a door latched position.
Figure 5:
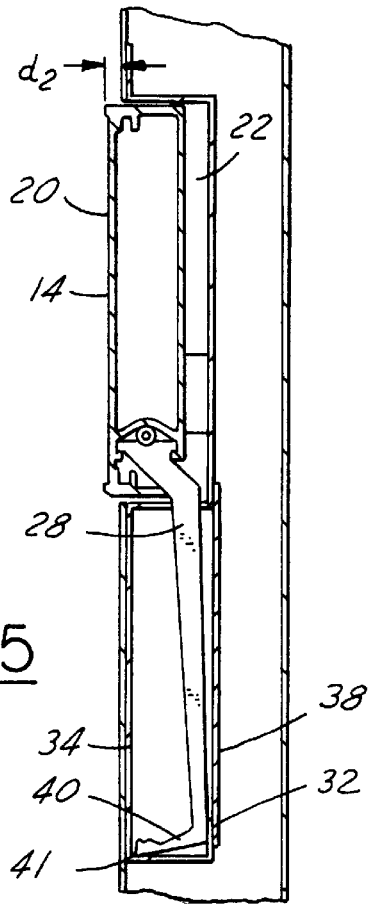
FIG. 5 is a cross-sectional view corresponding to FIG. 4 except that the operational bar is in the door unlatched position.

Referring now to FIGS. 4 and 5, operational bar 14 has a housing 20 which generally forms a rectilinear shape. As illustrated, housing 20 is generally hollow. However, housing 20 may also be made solid.

Operational bar 14 should be of sufficient length to act as a fire exit device. The length of operational bar 14 is not a function of the width of the door. That is, one length operational bar 14 is suitable for a variety of door widths, thus reducing the inventory of the manufacturing facility.

Door 12 has a recess 22 therein. Recess 22 is preferably sized just longer and just wider than operational bar 14 so that operational bar 14 may fit therein and move freely in and out. The depth of recess 22 is sized so that operational bar 14 may fit at least partially therein when the operational bar 14 is moved to open position. Recess 22 has a front side 34, a bottom side 36, and a back side 38.

Door 12 also has a channel 24 defined therein. Channel 24 is coupled to recess 22. Channel 24 is preferably integrally defined by the door 12 on all sides except the top where it is coupled to channel 24. Channel 24 preferably has an exterior finished surface 26 coextensive with door 12. Of course, one skilled in the art would recognize channel 24 may be formed of separate pieces assembled onto door 12.

Operational bar 14 has an arm 28 coupled thereto. Preferably, two arms fixedly coupled and spaced apart along the length of operational bar 14 are used. However, a single arm 28 having a width substantial enough to support operational bar 14 within recess 22 or more than two arms may be used to support bar 14. Arm 28 has a first end 30 coupled to operational bar 14. Arm 28 has a second end 32 extending into channel 24. First end 30 is preferably fixedly coupled to operational bar 14. First end 30, as illustrated, is coupled within operational bar 14. First end 30 may also be integrally molded or integrally formed with operational bar 14.

Arm 28 has a pivot extension 40 extending from second end 32. Preferably, pivot extension 40 extends substantially perpendicularly to arm 28. Pivot extension 40 extends into a corner 41 between front side 34 and bottom side 36 of recess 22. Arm 28 generally supports the weight of operational bar 14 against bottom side 36 of channel 24. Arm 28 allows bar 14 to pivot about a horizontal axis.

Arm 28 allows a force at any location upon operational bar 14 to be converted to a torque that is transmitted to the latch end of operational bar to open the door.

In operation, operational bar 14 extends a distance $d_1$ from face 13 as shown in FIG. 4 when the door is in a closed position. When door 12 is placed in an open position, as shown in FIG. 5, operational bar 14 extends a distance $d_2$. In one constructed embodiment, when door 12 is in the closed position, operational bar 14 at its uppermost point extends 0.625 inches from door 12. When door 12 is in the open position, the uppermost portion of operational bar 14 extends a distance of 0.125 inches from door 12. That is, operational bar 14 is virtually flush. Operational bar 14 preferably remains recessed until door 12 is closed. Preferably, little effort is required to open door 12. In the constructed embodiment, less than 15 pounds of force on operational bar 14 were required to open door 12.

Figure 6:
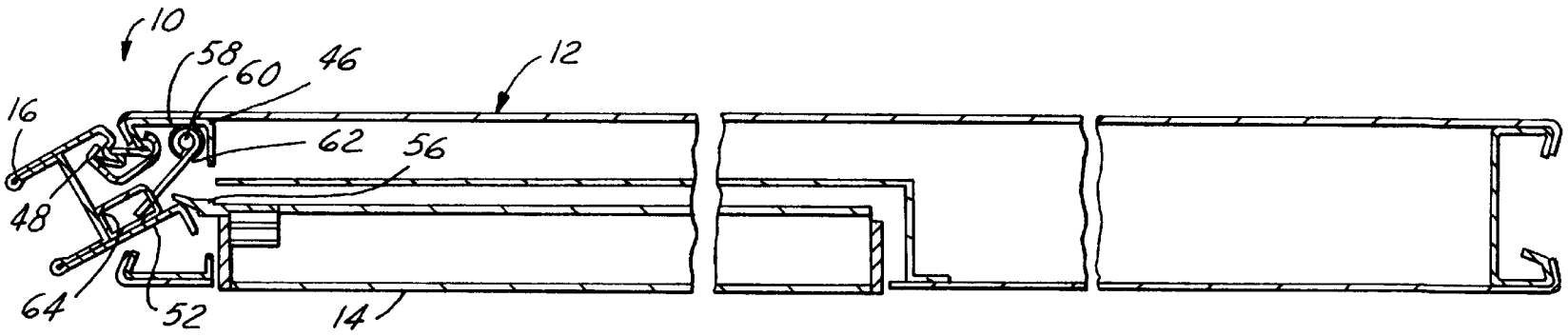
FIG. 6 is a lateral cross-sectional view of the exit device in the open position.
Figure 7:
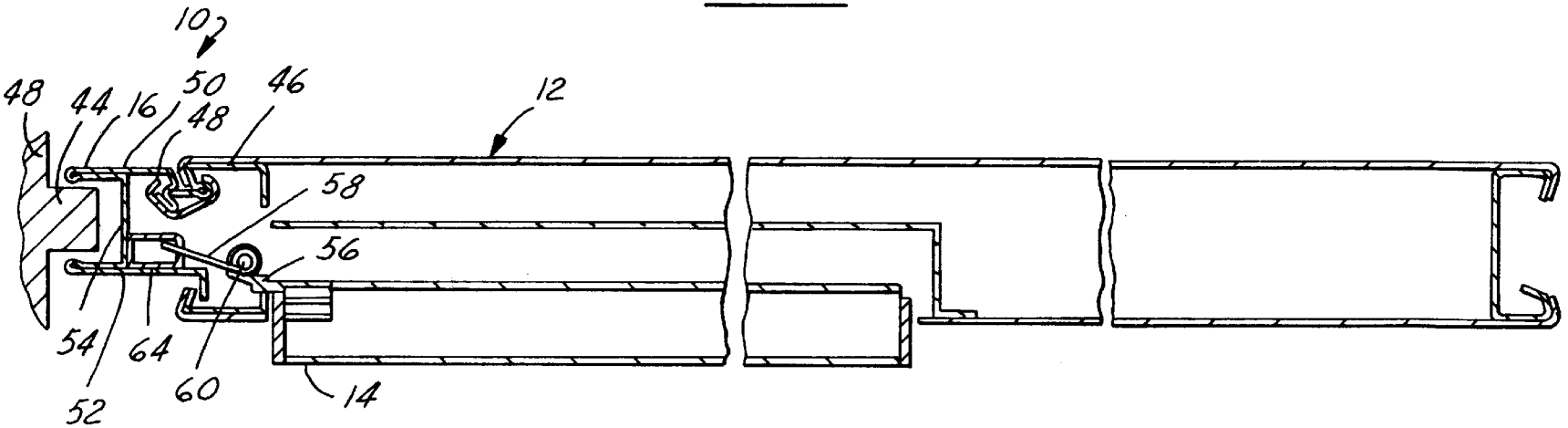
FIG. 7 is a cross-sectional view of the exit device of FIG. 6 in the closed position.

Referring now to FIGS. 6 and 7, in this embodiment, door 12 opens only by use of operational bar 14. No handle is provided on the exterior of door 12 opposite operational bar 14. Door 12 is shown adjacent to a door frame 42. Door frame 42 has an extension 44 onto which locking channel 16 may cooperate to hold door 12 in a locking position. A vertical stile 46 is coupled in an end of door 12. Vertical stile 46 preferably extends along the height of door 12 adjacent to locking channel 16, which also extends the height of door 12. Locking channel 16 is pivotally coupled to vertical stile 46. A clip 48, coextensive with vertical stile 46 and locking channel 16, couples vertical stile 46 to locking channel 16.

As shown, locking channel 16 is generally an H-shaped element having legs 50 and 52 with a center web 54 extending generally perpendicularly therebetween. Locking channel 16 has an elongated tube 64 located therein. Tube 64 is preferably coupled between leg 52 and web 54.

Operational bar 14 has an actuator arm 56 coupled thereto or integrally formed therewith. Actuator arm 56 extends into the open space defined by vertical stile 46. In the closed position, actuator arm 56 contacts a blocking member 58. Blocking member 58 has a rounded end around a pin 60. Blocking member 58 has a nylon roller 62.

In the open position, arm 52 of channel 16 contacts arm 56. Arm 52 holds operational bar 14 in a recessed position.

The opposite end of blocking member 58 from pin 60 extends into tube 64. Blocking member 58 essentially has two positions. As shown in FIG. 6, blocking member 58 is in the open position. As shown in FIG. 7, blocking member 58 is in a closed position. Blocking member 58 is used to position locking channel 16 in the open and closed position.

In operation, actuator arm 56 pushes against blocking member 58 in the area of pin 60 and roller 62. As operational bar 14 moves inward (i.e., going from a closed to open position), actuator arm 56 moves inward to push blocking member 58 against the opposite edge of vertical stile 46. Clip 48 acts as a hinge around which locking channel 16 pivots. Actuator arm 56 remains engaged with arm 52 of locking channel 16 to allow operational bar 14 to remain recessed in an open position. As will be further described below, retainer 18 (shown in FIG. 1) may also be used to hold locking channel 16 in the open position.

Figure 8:
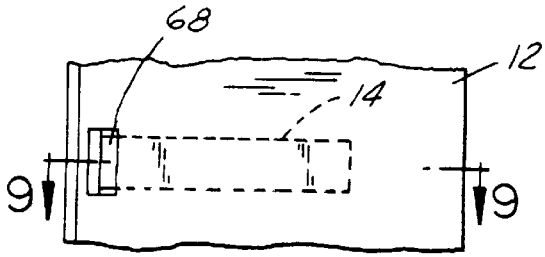
FIG. 8 is a partial elevational view of an alternative embodiment of an exit device according to the present invention.

Referring now to FIG. 8, a partial front view of a door 12 is shown that, in addition to operational bar 14, has an additional handle 68 located on the exterior side of the door. Handle 68 allows door 12 to be opened from the opposite direction than that of operational bar 14. Common reference numerals from the description above are used to describe the same components.

Figure 9:
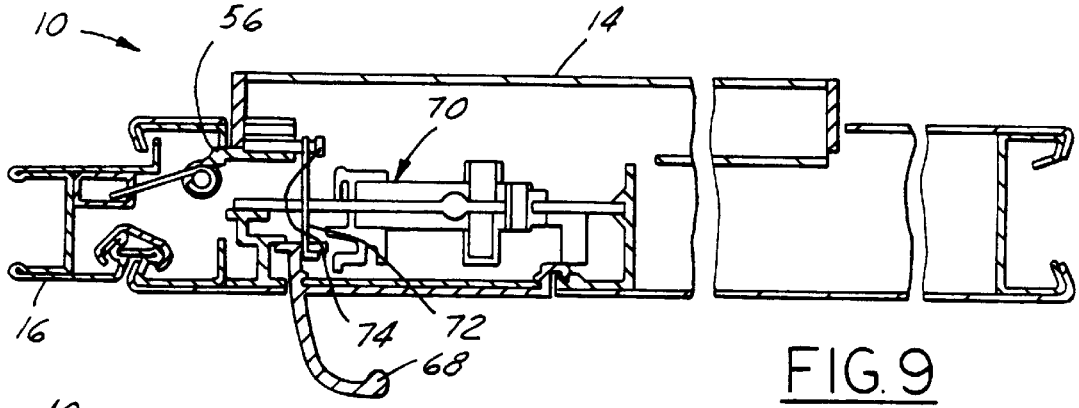
FIG. 9 is a cross-sectional view of the alternative design along line 9—9 of FIG. 8 in the closed position.
Figure 10:
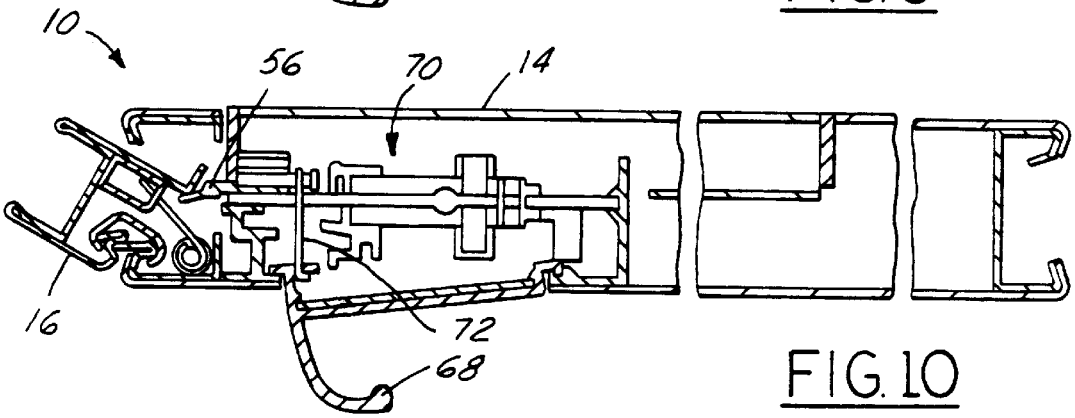
FIG. 10 is a cross-sectional view along line 10—10 of FIG. 8 showing the exit device in the open position.

Referring now to FIGS. 9 and 10, handle 68 extends into door 12. Along with the other mechanisms generally represented by reference numeral 70 that are commonly associated with various handles, handle 68 has a connection arm 72 coupled thereto. Actuator arm 56 has a connection pin 74 extending therefrom. Connection arm 72 is used to couple handle 68 and connection pin 74. As shown, connection arm 72 and actuator arm 56 are separate components; however, they may be initially formed. Thus, as handle 68 moves inward and outward with respect to door 12, connection arm 72 moves connection pin 74 inward and outward in registry therewith. In this manner, door 12 can be opened from both the inside of the door and the outside of the door. For locking purposes, handle 68 may be locked without impeding the operation of operational bar 14.

Figure 11:
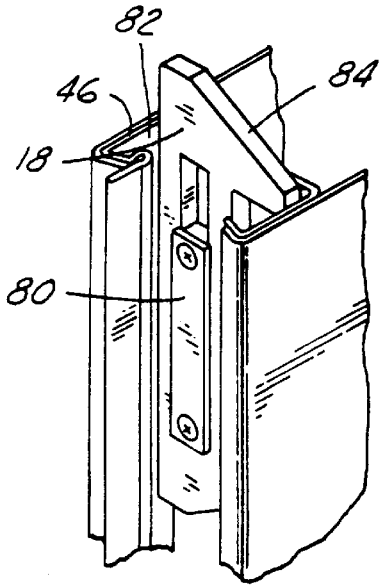
FIG. 11 is a perspective view of a retainer assembly mounted within a door.
Figure 12:
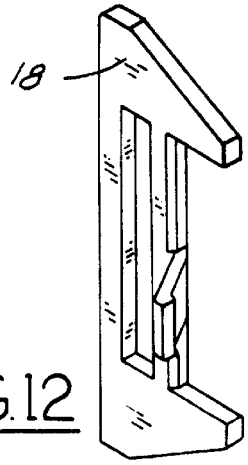
FIG. 12 is a perspective view of a retainer.

Referring now to FIGS. 11 and 12, the top portion of vertical stile 46 is shown in a perspective view. Retainer 18 is shown extending from the top of door 12. Retainer 18 is held in place within stile 46 by a guide block 80. As shown, guide block 80 is a member having a generally a T-shaped cross-section that fits within a retainer channel 82 through retainer 18. Retainer 18 is yieldably biased in the upward position by a spring (not shown). Retainer 18 is coupled to locking channel 16.

When door 12 is in an open position, retainer 18 extends out from the top of door 12. Retainer 18 has an angled portion 84 which contacts the frame of the door assembly. When the frame is being closed, the top portion of the frame is brought into contact with angled portion 84. Retainer 18 is pushed within vertical stile 46. This movement allows locking channel 16 to position itself into a closed position. Thus, the closed position is only achieved when the door 12 is almost into its closed position.

Retainer 18 holds locking channel 16 in the open position when the operational bar 14 is in the closed position. Retainer 18 holds operational bar 14 in the recessed position by contacting actuator arm 56.

While particular embodiments of the invention have been shown and described, numerous variations and alternate embodiments will occur to those skilled in the art. Accordingly, it is intended that the invention be limited only in terms of the appended claims.

What is claimed is:

1. A door assembly having a door with a door surface having a recess in the door and an exit assembly, said exit assembly comprising:

wherein said door has a channel, said channel having a front side and a bottom side, said channel coupled to the recess;

an operational bar located within the recess, said operational bar having a first position within said recess so that said operational bar is substantially flush with the door surface and a second position wherein said operational bar partially extends from said recess a distance from said first position;

an arm coupled to said operational bar, said arm having a first end and a second end, said first end is coupled to said operational bar, said second end extending entirely within said channel and supporting said operational bar; and a latching mechanism coupled to said operational bar through said door, said latching mechanism upon movement of said operational bar into a first position from a second position moving said latching mechanism to an open position.

2. A door assembly as recited in claim 1 further comprising a connection pin coupled to the operational bar, a handle located on an opposite side of the door from the operational bar, said operational bar and said connection pin coupled together through a connection arm.

3. A door assembly as recited in claim 1 further comprising a retainer coupled to a locking channel.

4. A door assembly as recited in claim 1 wherein said second end comprises a pivot extension.

5. A door assembly as recited in claim 4 wherein said pivot extension is positioned adjacent to said bottom side or said front side.

6. A door assembly having a door with a door surface having a recess in the door and an exit assembly, said exit assembly comprising:

an operational bar located within the recess, said operational bar having a first position within said recess so that said operational bar is substantially flush with the door surface and a second position wherein said operational bar partially extends from said recess a distance from said first position;

a latching mechanism coupled to said operational bar through said door, said latching mechanism upon movement of said operational bar into a first position from a second position moving said latching mechanism to an open position; and an actuator arm coupled to said operational bar, said actuator arm coupled to said latching mechanism, said actuator arm moving with said operational bar.

7. A door assembly as recited in claim 6 wherein said latching mechanism comprises a blocking member coupled to a pin.

8. A door assembly as recited in claim 7 wherein said actuator arm is operatively coupled to said blocking member.

9. A door assembly comprising:

a door with a recess between two door faces and a channel coupled to the recess, said channel and said recess entirely between said two door faces;

an exit assembly comprising;

an operational bar located at least partially within the recess, said operational bar having an open position within said recess wherein said operational bar is substantially flush with the door surface and a closed position wherein said operational bar partially extends from said recess a distance greater than in said first position, said operational bar having a support arm having a first end and a second end, said first end coupled to said operational bar, said second end located entirely within said recess and said channel for supporting said operational bar and positioning said operational bar relative to said recess; and a latching mechanism coupled to said operational bar through said door, said latching mechanism upon movement of said operational bar into the open position from the closed position moving said latching mechanism to an open position.

10. A door assembly as recited in claim 9 further comprising an actuator arm coupled to said operational bar, said actuator arm coupled to said latching mechanism, said actuator arm moving with said operational bar.

11. A door assembly as recited in claim 10 wherein said latching mechanism comprises a locking channel having a locking channel arm, said locking channel arm engaging said actuator arm in an open position thereby holding said operational bar within said recess.

12. A door assembly as recited in claim 9 wherein said support arm has a first end and a second end, said first end coupled to said operational bar, said second end extending within said channel.

13. A door assembly as recited in claim 12 wherein said second end comprises a pivot extension.

14. A door assembly as recited in claim 13 wherein said pivot extension is positioned adjacent to one of said two door faces.

15. A door assembly as recited in claim 9 further comprising a connection pin coupled to the operational bar, a handle located on an opposite side of the door from the operational bar, said operational bar and said connection pin coupled together through a connection arm.

16. A door assembly comprising:

a door having a vertical edge, a pair of door faces and a recess and a channel located entirely between said pair of door faces;

a vertical stile coupled to said vertical edge;

a locking channel movably coupled to said vertical stile;

a blocking member located with said vertical stile, said blocking member movably coupled to said locking channel, said blocking member having a first position and a second position;

an operational bar having a support arm coupled thereto, said operational bar located at least partially within said recess and said arm extending into said channel, said operational bar having an open position within said recess so that said operational bar extends a minimal distance from said door face so that said operational bar is substantially flush with the door face and a closed position wherein said operational bar partially extends from said recess a distance greater than the minimal distance; and an actuator arm coupled to said operational bar, and operatively coupled to said blocking member, said actuator arm moving said blocking member from a first position to a second position when said operational bar is moved into said recess into said open position.

17. A door assembly as recited in claim 16 wherein said locking channel has a locking channel arm, said locking channel arm engaging said actuator arm in an open position to hold said operational bar within said recess.

18. A door assembly as recited in claim 16 further comprising a retainer coupled to said stile.

19. A door assembly as recited in claim 18 releasing said blocking member from a second position to a first position upon contact with a door frame.

20. A door assembly as recited in claim 18 further comprising a guide block coupling said retainer within said stile.

21. A door assembly as recited in claim 18 wherein said retainer having a retainer channel for receiving said guide block.

22. A door assembly as recited in claim 16 further comprising a connection pin coupled to the operational bar, a handle located on an opposite side of the door from the operational bar, said operational bar and said connection pin coupled together through a connection arm.

23. A door assembly as recited in claim 16 wherein said channel having a front side and a bottom side, said channel coupled to said recess.

24. A door assembly as recited in claim 23 further comprising an arm coupled to said operational bar, said arm having a first end and a second end, said first end is coupled to said operational bar.

25. A door assembly as recited in claim 24 wherein said arm pivots about a horizontal axis.

26. A door assembly as recited in claim 24 wherein said second end comprises a pivot extension.

27. A door assembly as recited in claim 25 wherein said pivot extension is positioned adjacent to said bottom side and said front side.

* * * * *